US006354270B1

(12) United States Patent
Shafer

(10) Patent No.: US 6,354,270 B1
(45) Date of Patent: Mar. 12, 2002

(54) HYDRAULICALLY ACTUATED FUEL INJECTOR INCLUDING A PILOT OPERATED SPOOL VALVE ASSEMBLY AND HYDRAULIC SYSTEM USING SAME

(75) Inventor: Scott F. Shafer, Morton, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/606,738

(22) Filed: Jun. 29, 2000

(51) Int. Cl.[7] ..... F02M 37/04; F02M 47/04

(52) U.S. Cl. ..... 123/446; 123/502; 123/506; 239/533.8; 137/625.64

(58) Field of Search ..... 123/446, 502, 123/506; 239/88, 89, 50, 51, 92, 533.3, 533.4, 533.8; 137/625.25, 625.6, 625.64, 625.68, 625.34

(56) References Cited

U.S. PATENT DOCUMENTS

| | | | | |
|---|---|---|---|---|
| 4,403,583 A | | 9/1983 | Ehiem | |
| 4,458,645 A | | 7/1984 | Schwartzman | |
| 4,489,698 A | | 12/1984 | Hofer et al. | |
| 4,745,898 A | | 5/1988 | Egler et al. | |
| 4,764,092 A | | 8/1988 | Thornthwaite | |
| 4,831,988 A | | 5/1989 | Hoefken et al. | |
| 5,024,200 A | | 6/1991 | Free et al. | |
| 5,239,968 A | | 8/1993 | Rodriguez-Amaya et al. | |
| 5,271,371 A | * | 12/1993 | Meints et al. | 123/446 |
| 5,425,342 A | | 6/1995 | Ariga et al. | |
| 5,526,791 A | | 6/1996 | Timmer et al. | |
| 5,669,355 A | | 9/1997 | Gibson et al. | |
| 5,682,858 A | | 11/1997 | Chen et al. | |
| 5,687,693 A | | 11/1997 | Chen et al. | |
| 5,697,342 A | | 12/1997 | Anderson et al. | |
| 5,700,136 A | | 12/1997 | Sturman | |
| 5,713,520 A | | 2/1998 | Glassey et al. | |
| 5,720,318 A | * | 2/1998 | Nagarajan et al. | 137/625.64 |
| 5,738,075 A | | 4/1998 | Chen et al. | |
| 5,826,562 A | | 10/1998 | Chen et al. | |
| 5,833,146 A | | 11/1998 | Hefler | |
| 5,842,452 A | * | 12/1998 | Pattanaik | 123/467 |
| 5,975,139 A | * | 11/1999 | Carroll et al. | 137/625.64 |
| 6,102,004 A | * | 8/2000 | Cowden et al. | 123/446 |
| 6,113,000 A | * | 9/2000 | Tian | 239/88 |
| 6,129,072 A | * | 10/2000 | Graves | 123/446 |
| 6,142,394 A | * | 11/2000 | Hefler et al. | 239/533.8 |

* cited by examiner

*Primary Examiner*—Tony M. Argenbright
*Assistant Examiner*—Hai Huynh
(74) *Attorney, Agent, or Firm*—Liell & McNeil

(57) ABSTRACT

The present invention relates to hydraulic systems including hydraulically actuated fuel injectors that have a pilot operated spool valve assembly. One class of hydraulically actuated fuel injectors includes a solenoid driven pilot valve that controls the initiation of the injection event. However, during cold start conditions, hydraulic fluid, typically engine lubricating oil, is particularly viscous and is often difficult to displace through the relatively small drain path that is defined past the pilot valve member. Because the spool valve typically responds slower than expected during cold start due to the difficulty in displacing the relatively viscous oil, accurate start of injection timing can be difficult to achieve. There also exists a greater difficulty in reaching the higher end of the cold operating speed range. Therefore, the present invention utilizes a fluid evacuation valve to aid in displacement of the relatively viscous oil during cold start conditions.

20 Claims, 3 Drawing Sheets

HYDRAULICALLY ACTUATED FUEL INJECTOR INCLUDING A PILOT OPERATED SPOOL VALVE ASSEMBLY AND HYDRAULIC SYSTEM USING SAME

GOVERNMENT LICENSE RIGHTS

This invention was made with Government support under DE-FC05-970R22605 awarded by the United States Department of Energy. The Government has certain rights in this invention.

TECHNICAL FIELD

This invention relates generally to pilot operated spool valve assemblies, and more particularly to hydraulically actuated fuel injectors that use such valves.

BACKGROUND ART

Hydraulically actuated fuel injectors are used in many internal combustion engines and have performed very well over the years. In these injectors, high pressure hydraulic oil is used to pressurize fuel for injection into the combustion space and also to control the opening and closing of valves within the injector body. In one class of hydraulically actuated fuel injectors, a solenoid-driven pilot valve controls the initiation of the injection event. One example of such a fuel injector is described in U.S. Pat. No. 5,682,858, issued to Chen et al. on Nov. 4, 1997. When the pilot valve is actuated, the pressure control passage defined by the valve body becomes fluidly connected to a low pressure vent. This sudden drop in pressure allows both the opening of a spring-biased direct control needle valve and the downward movement of a spring-biased spool valve member. When the spool moves to its downward position, it allows high pressure actuation fluid to drive an intensifier piston down, pressurizing fuel sufficiently to lift the needle valve and open the nozzle outlet. The use of an electronically controlled hydraulic system to inject fuel allows the timing and quantity of fuel injected to be precisely controlled, resulting in improved engine performance and better emissions.

The performance and efficiency levels reached with pilot operated spool valve assemblies are excellent. There is of course always room for improvement, especially under certain operating conditions. One development challenge in particular involves the displacement of cold hydraulic fluid from below the spool when the spool valve member travels downward at the initiation of an injection event. The plumbing in earlier injectors often required nearly full travel of the spool before start of injection could occur. During cold start, the hydraulic oil is particularly viscous, rendering it more difficult to displace through the relatively small drain path provided past the pilot valve member. This in turn can sometimes result in excessive spool travel times and correspondingly longer than desired start of current to start of injection times.

This slower spool valve response is a major factor in reducing the level of performance, resulting in difficulty achieving accurate start of injection timing (especially during cranking) and difficulty in reaching the higher end of the cold operating speed range. In earlier injectors of this type, such as that taught in Chen et al., the only path for draining the fluid beneath the spool was up the passage that controls check motion (the pressure control passage), and past the pilot stage lower seat. Therefore, a hydraulically actuated fuel injector including alternate means for evacuating hydraulic fluid could improve performance of hydraulically actuated fuel injectors, particularly at cold start.

The present invention is directed to overcoming one or more of the problems as set forth above.

DISCLOSURE OF THE INVENTION

In one aspect of the present invention, a pilot operated spool valve assembly includes a valve body defining a high pressure passage, a low pressure passage, a pressure control passage and a low pressure space. A spool valve member is movably positioned in the valve body and has a control hydraulic surface that is exposed to fluid pressure in the pressure control passage. A pilot valve member is positioned in the valve body and has a first position in which the high pressure passage is fluidly connected to the pressure control passage and a second position in which the low pressure passage is fluidly connected to the pressure control passage. A fluid evacuation valve member is positioned in the valve body and is movable between an open position in which the pressure control passage is fluidly connected to the low pressure space and a closed position.

In another aspect of the present invention, a hydraulic device includes a device body that defines a high pressure passage, a low pressure passage, a pressure control passage, and actuation fluid passage and a low pressure space. A spool valve member is positioned in the device body and has a control hydraulic surface that is exposed to fluid pressure in the pressure control passage. The spool valve member is movable between an on position in which the actuation fluid passage is open to the high pressure passage and an off position in which the actuation fluid passage is open to the low pressure passage. A pilot valve member is positioned in the device body that has a first position in which the high pressure passage is fluidly connected to the pressure control passage, and a second position in which the low pressure passage is fluidly connected to the pressure control passage. A fluid evacuation valve member is positioned in the device body and is movable between an open position in which the pressure control passage is fluidly connected to the low pressure space and a closed position. A piston is movably positioned in the device body and has a hydraulic surface that is exposed to fluid pressure in the actuation fluid passage.

In yet another aspect of the present invention, a method of operating a control valve includes providing a pilot operated spool valve assembly having a valve body that defines a high pressure passage and a low pressure passage, and has a spool valve member, a pilot valve member and a fluid evacuation valve member. The pilot valve member is moved to a first position to expose a control hydraulic surface of the spool valve member and a closing hydraulic surface of the fluid evacuation valve member to the low pressure passage. The spool valve member is then moved toward an on position to expose the fluid evacuation valve member to fluid pressure. Next the fluid evacuation valve member is moved to an open position. The pilot valve member is then moved to a second position to expose a control hydraulic surface of the spool valve member and a closing hydraulic surface of the fluid evacuation valve member to the high pressure passage. The spool valve member is moved toward an off position. The fluid evacuation valve member is moved to a closed position.

BEST MODE FOR CARRYING OUT THE INVENTION

Figure 1:
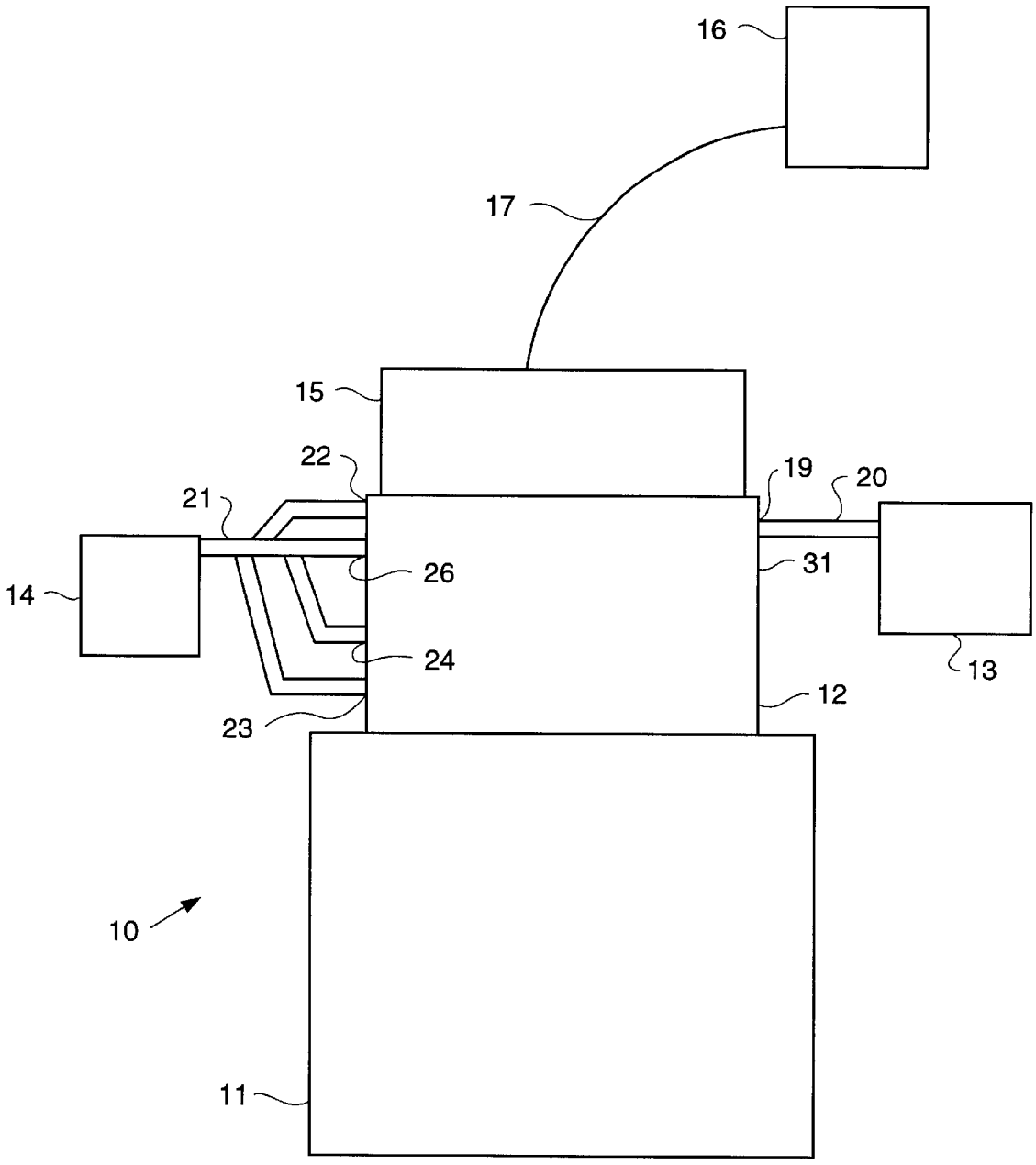
FIG. 1 is a diagrammatic representation of a hydraulic system that includes a hydraulic device according to the present invention.

Referring first to FIG. 1, there is shown a system level diagram of a hydraulically actuated electronically controlled system according to the present invention. Hydraulic system 10 has a hydraulically actuated device 11 such as a fuel injector or engine gas exchange valve. A control valve assembly 12 alternately exposes hydraulically actuated device 11 to a source of high pressure hydraulic fluid 13 or a low pressure reservoir 14. Control valve assembly 12 is operated by energizing or de-energizing an electrical actuator 15. Electrical actuator 15 is preferably a solenoid, but could also be another suitable device such as a piezoelectric actuator. Electrical actuating device 15 is controlled by electronic control module 16 via communication line 17 in a conventional manner.

In the preferred embodiment, control valve assembly 12 has an injector body 31 that defines a high pressure inlet 19 connected via high pressure supply line 20 to high pressure fluid source 13. Injector body 31 further defines low pressure vents 22, 23, and 24, and low pressure drain 26. Low pressure vents 22, 23, and 24, and low pressure drain 26 connect to low pressure fluid reservoir 14 via low pressure line 21. In the preferred embodiment, low pressure reservoir 14 is fluidly connected to vents 22, 23, and 24, and drain 26 though this need not be the case. Fuel injector 30, shown as part of the system pictured in FIG. 1, is shown in detail in FIG. 2.

Figure 2:
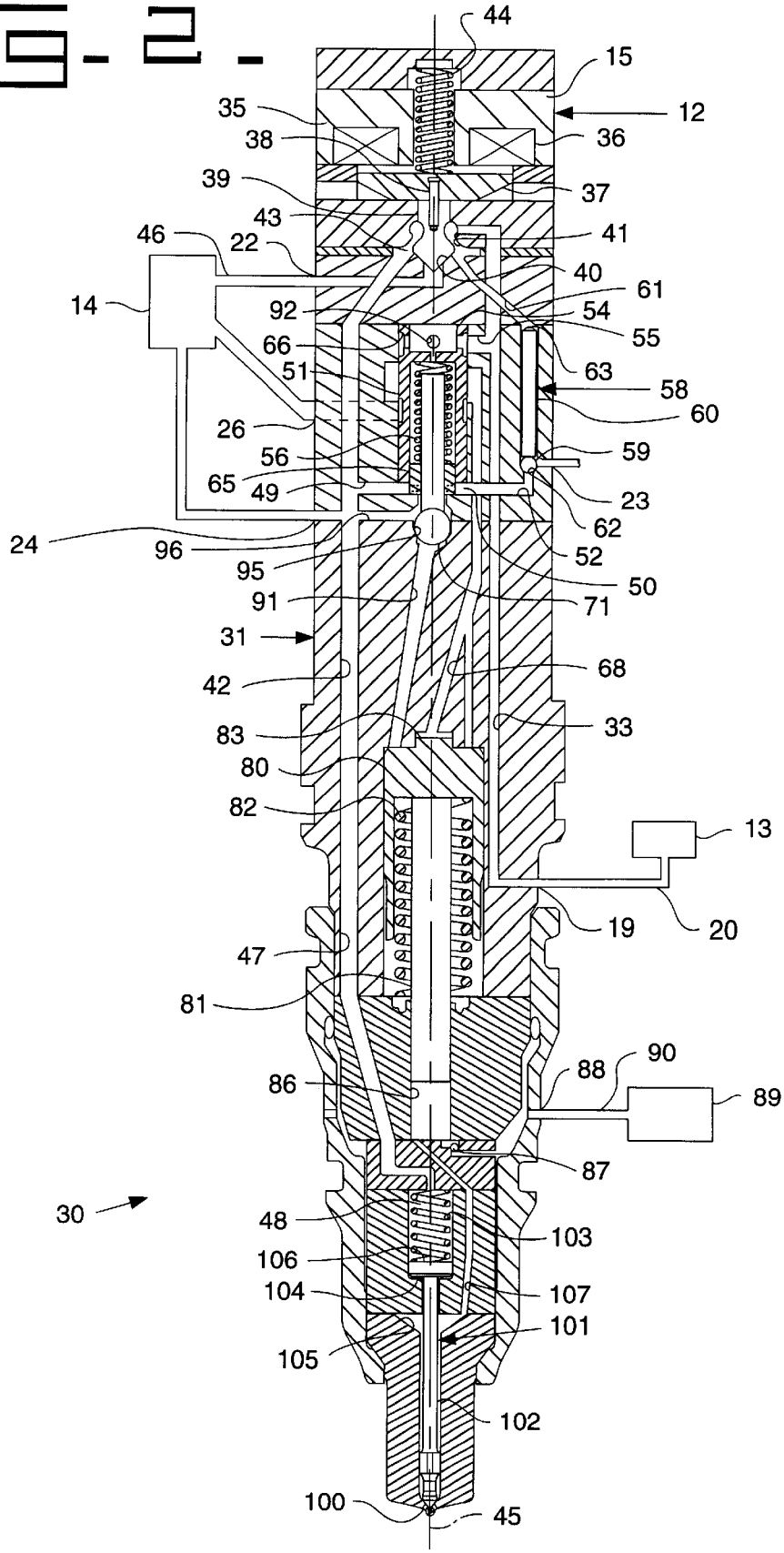
FIG. 2 is a diagrammatic sectioned side view of a hydraulically actuated electronically controlled fuel injector according to the present invention.

Referring now to FIG. 2, there is shown a diagrammatic sectioned side view of a hydraulically actuated electronically controlled fuel injector 30 according to the present invention. Fuel injector 30 consists of an injector body 31 made up of various components attached to one another in a manner well known in the art, and a number of movable internal parts positioned in the manner they would be just prior to the start of an injection event. As discussed with regard to FIG. 1, actuation fluid source 13 supplies fluid to high pressure passage 33 defined by injector body 31 via high pressure supply line 20 through high pressure inlet 19. The present invention utilizes engine lubricating oil as actuation fluid, though transmission, power steering, brake, coolant, or some other suitable engine fluid might be utilized.

Fuel injector 31 is controlled in operation by a control valve assembly 12 that is preferably attached to and located within the injector itself. Control valve assembly 12 has an electrical actuator 15 that is preferably a solenoid but might also be another suitable device such as a piezoelectric actuator. Solenoid 35 has a coil 36, an armature 37, and a screw 38. Screw 38 attaches armature 37 to a pilot valve member 39. Pilot valve member 39 has been shown as a poppet valve member, but it should be appreciated that it could instead be another suitable valve type, such as a ball and pin. Pilot valve member 39 is relatively fast moving and is movable within injector body 31 between a downward position in which it closes a conical low pressure seat 40 and an upward position in which it closes a conical high pressure seat 41.

Figure 3:
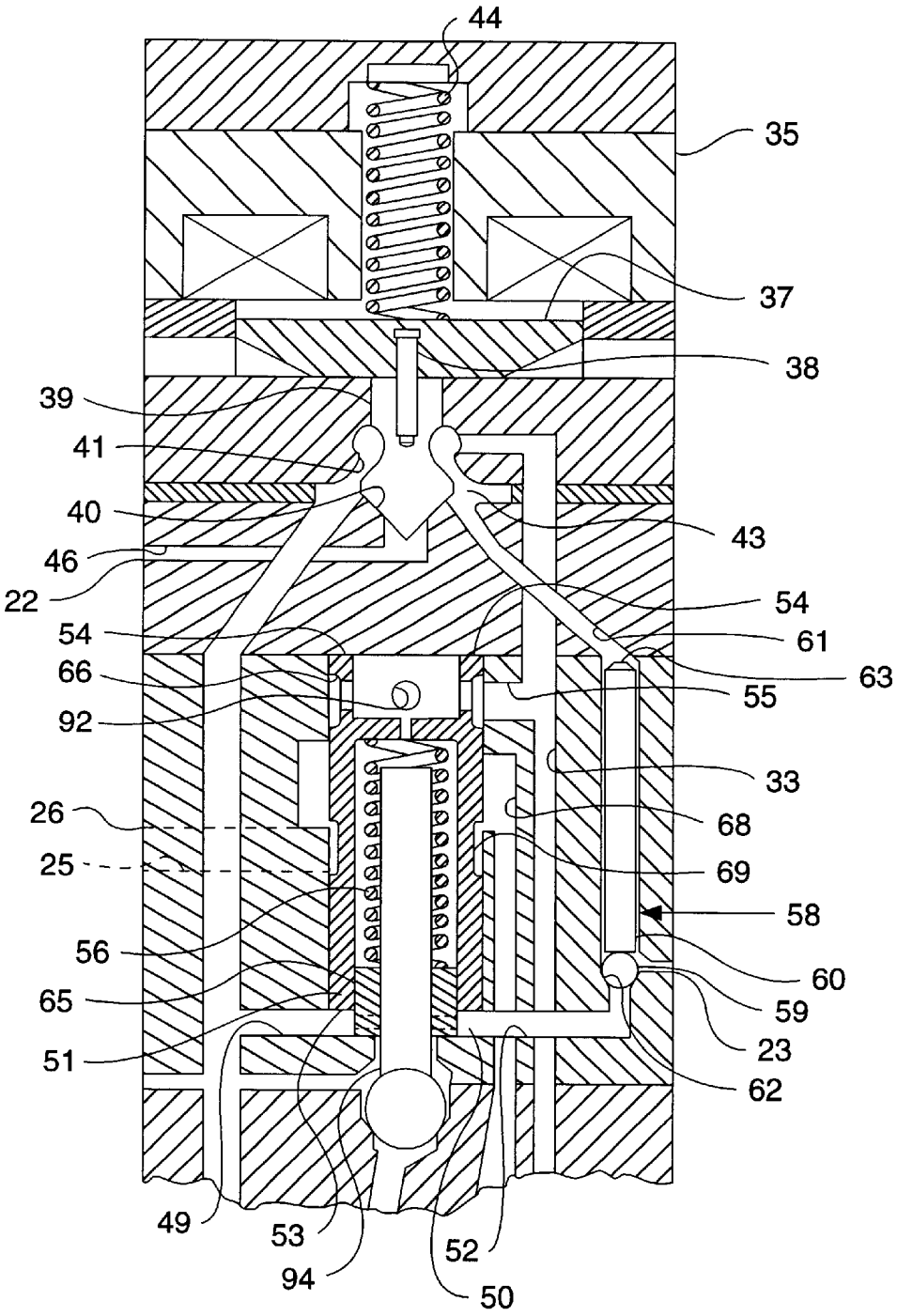
FIG. 3 is a sectioned side view of the pilot-operated spool valve assembly portion of the fuel injector shown in FIG. 2.

Injector body 31 also defines a pressure control passage 42 that opens into a control volume cavity 43 between low pressure seat 40 and high pressure seat 41. Prior to an injection event when solenoid 35 is de-energized, pilot valve member 39 is held in its downward position by biasing spring 44 so as to close low pressure seat 40, as shown in FIGS. 2 and 3. In pilot valve member 39's downward position, pressure control passage 42 is open to high pressure supply passage 33 by way of control volume cavity 43. In this downward position, pilot valve member 39 blocks pressure control passage 42 from fluid communication with low pressure passage 46. When pilot valve member 39 is moved to its upward position by energizing solenoid 35, pressure control passage 42 is in fluid communication with low pressure passage 46 and closed to fluid communication with high pressure passage 33.

Pressure control passage 42 has a first branch passage 49 which is in fluid communication with a control volume cavity 50 beneath spool valve member 51 and a second branch passage 47 which is fluidly connected to a needle control chamber 48. The control volume cavity 50 beneath spool valve member 51 is defined in part by injector body 31 and in part by spool valve member 51. Spool valve member 51 is relatively slow moving and is movable within injector body 31 between an upper and a lower position. Spool valve member 51 has a control hydraulic surface 53 that is exposed to variable pressure in spool control volume cavity 50 and a biasing hydraulic surface 54 that is continuously exposed to high pressure via radial bores 92 and annulus 66 from high pressure branch passage 55. Spool valve member 51 moves up and down within injector body 31 and is preferably guided in this movement by a travel sleeve 65.

When solenoid 35 is de-energized and pilot valve member 39 is in its lower position closing low pressure seat 40, control hydraulic surface 53 of spool valve member 51 is exposed to high pressure in control volume cavity 50. When solenoid 35 is energized and pilot valve member 39 moves with armature 37 toward its upward position, closing high pressure seat 41, spool valve member 51's control hydraulic surface 53 is exposed to low pressure in volume control cavity 50. Constant fluid communication between the spool control volume 50 and control volume 43 via branch passage 49 and pressure control passage 42 allows the pressure on the spool's hydraulic surface 53 to be controlled through the action of pilot valve member 39.

The top of spool valve member 51 has a biasing hydraulic surface 54 that is continuously exposed to high pressure from high pressure supply passage 33 via a branch passage 55, through an annulus 66 machined around spool valve member 51. Annulus 66 provides fluid communication between branch passage 55 and biasing hydraulic surface 54 via four radial bores 92 around the body of spool valve member 51. Radial bores 92 are preferably drilled at ninety degree angles perpendicular to spool valve member 51's travel. Equal fluid pressure acts on spool hydraulic surfaces 53 and 54, and their equal areas result in hydraulic balance of spool valve member 51.

Biasing spring 56 biases spool valve member 51 toward its upper position as shown in FIGS. 2 and 3. This hydraulically balanced state of spool valve member 51 is not necessary for proper functioning of this or a similar device but is preferred. A stronger or weaker biasing spring could be employed to compensate for unequal hydraulic pressures on the respective hydraulic surfaces of the spool valve member.

When spool valve member 51 is in its upward (off) position, it provides fluid communication between actuation fluid passage 68 and low pressure drain 26. When solenoid 35 is de-energized and pilot valve member 39 is in its lower position, closing low pressure seat 40, spool valve member 51 is hydraulically balanced, as described above, and biased toward its upward position from the force of biasing spring 56. In this position an annulus 69 provides fluid communication between actuation fluid passage 68 and low pressure drain 25. In its lower (on) position, spool valve member 51 provides fluid communication between actuation fluid passage 68 and high pressure passage 33 via branch passage 55. When solenoid 35 is energized, pilot valve member 39 moves to its second position closing high pressure seat 41, pressure control passage 42 is exposed to low pressure, and control volume cavity 43 is exposed to low pressure via low pressure drain 46. In this energized state, the control hydraulic surface 53 of spool valve member 51 is exposed to low pressure in spool control volume cavity 50 via branch passage 49. Because spool valve member 51 is no longer hydraulically balanced when solenoid 35 is energized, with high pressure prevailing on its biasing hydraulic surface 54, the hydraulic pressure overcomes the force of biasing spring 56 and spool 51 travels downward toward its lower position.

Control volume cavity 50 provides continuous fluid communication between pressure control passage 42 and a fluid evacuation passage 52, also defined by valve or injector body 31. Fluid evacuation passage 52 may be closed or alternatively opened by a fluid evacuation valve 58 to a low pressure vent 23. Fluid evacuation valve 58 is positioned within valve body 31 and is movable between an open position in which spool control volume cavity 50 is connected to the low pressure space via fluid evacuation passage 52, and a closed position which closes passage 52. Fluid evacuation valve 58 comprises a ball 59 adjacent a conical seat 62 and a pin 60 which is closely fitted within a variable pressure passage 61 defined by valve body 31. Passage 61 is in constant fluid communication with control volume cavity 43. When pilot valve member 39 is in its first position closing low pressure seat 40, high pressure from control volume cavity 43 prevails in variable pressure passage 61 and thus upon closing hydraulic surface 63 of pin 60. As a result, pin 60 exerts downward force on ball 59, and closes fluid evacuation valve 58 by seating ball 59 in seat 62. When fluid evacuation valve 58 is held closed by the high pressure in variable pressure passage 61, fluid evacuation passage 52 is closed to low pressure vent 23. Pin 60 is sized such that the area of its hydraulic surface 63 is larger than the hydraulic surface area of ball 59. This ensures that pin 60 provides a seating force on ball 59 such that passage 52 will be held closed when high pressure prevails in variable pressure passage 61 and in passage 52. When pilot valve member 39 is in its second position closing high pressure seat 41, variable pressure passage 61 is open to low pressure in control volume cavity 43 via low pressure passage 46. Because there is now low pressure in passage 61, there is no longer a significant hydraulic force on hydraulic surface 63. As a result, pin 60 does not exert significant downward force on ball 59. As spool valve member 51 travels downward, it must displace the hydraulic fluid filling control volume 50. When passage 61 is exposed to low pressure, the downward travel of spool valve member 51 creates fluid pressure in passage 52 that is sufficient to push ball 59 up and out of contact with conical seat 62 such that the fluid can be evacuated.

Returning now to fuel injector 30, injector body 31 also has a reciprocating pumping element which has a piston 80, and a plunger 81 which move between an upward position, as shown in FIG. 2, and a downward advanced position. The pumping element connected to piston 80, plunger 81, is biased toward its upward position by return spring 82. Piston 80 advances to its downward position when hydraulic pressure acts on a hydraulic surface 83 that is exposed to hydraulic pressure in actuation fluid passage 68. The hydraulic pressure in actuation fluid passage 68 is variable and controlled by the action of control valve assembly 12. When spool valve member 51 is in its upward position, low pressure prevails in actuation fluid passage 68, and piston 80 is biased toward its upward position by spring 82. When solenoid 35 is energized and pilot valve member 39 is in its second position closing high pressure seat 41, spool valve member 51 moves to its lower position. In this lower position, spool valve member 51 fluidly connects actuation fluid passage 68 to high pressure in passage 55 via annulus 66. Consequently, the hydraulic surface 83 of piston 80 is exposed to high pressure, which moves piston 83 downward. Correspondingly, plunger 81 is forced downward with the motion of piston 80, and acts as the means of pressurizing fuel within fuel pressurization chamber 86.

Fuel pressurization chamber 86 is connected to a fuel inlet 88 past a ball check valve 87. Fuel inlet 88 is connected to a source of fuel 89 via a fuel supply passage 90. Distillate diesel fuel is preferably used, but gasoline or another suitable type of fuel might be used. When plunger 81 is returning to its upward position, fuel is drawn into fuel pressurization chamber 86 past check valve 87. During an injection event, as plunger 81 moves downward, check valve 87 is held closed and plunger 81 can act to compress fuel within fuel pressurization chamber 86.

A pressure relief valve 71 is movably positioned in injector body 31 to vent pressure spikes from actuation fluid passage 68. Pressure spikes can be created when piston 80 and plunger 81 abruptly stop their downward movement due to the abrupt closure of nozzle outlet 100. Because pressure spikes can sometimes cause an undesirable secondary injection due to an interaction of components and passageways over a brief instant after main injection has ended, pressure relief passage 91 connects actuation fluid passage 68 and low pressure vent 24 via pressure relief side passage 96. When spool valve member 51 is in its downward position, it preferably contacts and exerts downward force on the top of pressure relief valve member 94, holding it against seat 95, closing valve 71. When pressure relief valve 71 is held in this closed position, actuation fluid passage 68 and pressure relief passage 91 are closed to pressure relief side passage 96, and high pressure can drive piston 80 and plunger 81 down to inject fuel. When spool valve member 51 is in its upward position, pressure relief valve 71 may open, and excess pressure may be relieved through vent 24 during the return action of piston 80 and plunger 81.

Returning again to fuel injector 30 of FIG. 2, a direct control needle valve 101 is positioned within injector body 31 and has a needle valve member 102 that is movable between an up position and a down position. In needle valve member 102's up position, nozzle outlet 100 defined by injector body 31 is open, and in its down position nozzle outlet 100 is closed. Needle valve member 102 is mechanically biased toward its downward (closed) position by biasing spring 103. Needle valve member 102 has opening hydraulic surfaces 104 that are exposed to fluid pressure within a nozzle chamber 105 and a closing hydraulic surface 106 that is exposed to fluid pressure within a needle control chamber 48. Chamber 48 is in fluid communication with pressure control passage 42 via its second branch passage 47. Therefore, closing hydraulic surface 106 of needle valve member 101 is exposed to high pressure passage 33 via control volume cavity 43 when solenoid 35 is de-energized, and pilot valve member 39 is in its down position closing low pressure seat 40. In a similar manner, closing hydraulic surface 106 is exposed to low pressure when solenoid 35 is energized and pilot valve member 39 closes high pressure seat 41. Closing hydraulic surface 106 and opening hydraulic surfaces 104 are sized such that, even when a valve opening pressure is attained in nozzle chamber 105, needle valve member 102 will not open against the action of biasing spring 103 so long as needle control chamber 48 is exposed to high pressure in passage 47. Similarly, once solenoid 35 is de-energized, the high pressure in needle control chamber 48 and the force of biasing spring 103 will act quickly to move needle valve member 102 down to close nozzle outlet 100 and end the injection event. It should be appreciated that the relative sizes of closing hydraulic surface 106 and opening hydraulic surface 104 and the force of biasing spring 103 should be such that needle valve 101 will open when the valve opening pressure is reached in fuel pressurization chamber 86 and pressure acting on surface 106 is low.

Industrial Applicability

Before the beginning of an injection event, low pressure prevails in fuel pressurization chamber 86, piston 80 and plunger 81 are in their retracted position, pilot valve member 39 is in its lower position closing low pressure seat 40, fluid evacuation valve 58 is held closed by rail pressure in variable pressure passage 61, and needle valve member 102 is in its biased position closing nozzle outlet 100. Spool control volume 50 and fluid evacuation passage 52 are in fluid communication with high pressure supply passage 33 via pressure control passage 42 through control volume cavity 43. Actuation fluid passage 68 is in fluid communication with low pressure passage 25 via annulus 69. Pilot valve member 39 is held by biasing spring 44 in its down position. Spool valve member 51 is hydraulically balanced and biased toward its up position by biasing spring 56. Injection is initiated by activation of solenoid 35, which causes armature 37 to move pilot valve member 39 upward to close high pressure seat 41.

When pilot valve member 39 closes high pressure seat 41, pressure control passage 42 and variable pressure passage 61 become fluidly connected to low pressure passage 46 via control volume 43. As a result, the pressures in both control volume cavity 50 and needle control chamber 48 drop dramatically. The drop in pressure in control volume cavity 50 results in hydraulic imbalance of spool valve member 51. Because lower pressure is now acting on control hydraulic surface 53 than on biasing hydraulic surface 54, the high pressure acting on hydraulic surface 54 overcomes the upward force of biasing spring 56, and spool valve member 51 moves toward its downward position. As spool valve member 51 moves down, hydraulic fluid below the spool is displaced in part through first branch passage 49, past seat 40, and in larger part through fluid evacuation passage 52 and out through low pressure vent 23 via fluid evacuation valve 58. Recall that prior to an injection event, when pilot valve member 39 is in its down position, fluid evacuation valve 58 is held closed by high pressure on the closing hydraulic surface 63 of pin 60. When pilot valve member 39 moves to its up position to initiate an injection event, the closing hydraulic surface of pin 60 is exposed to low pressure in variable pressure passage 61 via volume control cavity 43 and low pressure passage 46. Consequently, the fluid pressure from the downward travel of spool valve member 51 is sufficient to push ball 59 and pin 60 upward, opening fluid evacuation valve 58 and draining the excess fluid. Fluid evacuation valve 58 is designed such that it provides a drain path larger than the drain path past pilot valve member 39 and around low pressure seat 40.

The high speed with which pilot valve member 39 moves often necessitates that the distance it travels up and down be very short. As a result, the possible flow area around it for displacing hydraulic fluid is very small. Fluid evacuation valve 58 facilitates draining of the fluid from beneath the spool that had in earlier injectors been drained only by the path past pilot valve member 39 and low pressure seat 40. Because fluid evacuation valve 58 itself necessarily displaces a certain amount of hydraulic fluid when it opens, pin 60's diameter should be carefully sized. The area of hydraulic surface 63 must be small enough that the volume of fluid displaced when pin 60 moves up into variable pressure passage 61 is substantially smaller than the volume displaced by the downward movement of spool valve member 51. However, the area of hydraulic surface 63 must not be so large that fluid pressure from the downward movement of spool valve member 51 cannot push open fluid evacuation valve 58. Fluid evacuation valve 58 is shown as a ball and pin, however, it should be appreciated that another suitable valve type such as a poppet valve might be substituted.

As spool valve member 51 travels downward from the force of high pressure fluid on biasing hydraulic surface 54, low pressure annulus 69 ceases to provide fluid communication between actuation fluid passage 68 and low pressure passage 25. As spool valve member 51 continues downward, high pressure annulus 66 opens actuation fluid passage 68 to high pressure supply passage 33 via branch passage 55. Because spool valve member 51 is in its down position, pressure relief valve 71 is held closed by contact between pin 94 and spool valve member 51. As a result, high pressure can build in actuation fluid passage 68.

When actuation fluid passage 68 becomes fluidly connected to high pressure branch passage 55, the high pressure acting on hydraulic surface 83 causes piston 80 to move downward against the action of biasing spring 103. The downward movement of piston 80 results in a corresponding downward movement of plunger 81. The downward movement of plunger 81 forces check valve 87 closed and raises the pressure of the fuel within fuel pressurization chamber 86, nozzle supply passage 107, and nozzle chamber 105. Recall that at this instant low pressure is acting on closing hydraulic surface 106 of needle valve member 102. When the fuel pressure exerted on opening hydraulic surfaces 104 exceeds a valve opening pressure, needle valve member 102 is lifted against the action of biasing spring 103, and fuel is allowed to spray into the combustion chamber from nozzle outlet 100.

Shortly before the desired amount of fuel has been injected into the combustion space, current to solenoid 35 is ended to end the injection event. Solenoid 35 is de-energized and pilot valve member 39 moves under the force of biasing spring 44 and fluid pressure to close low pressure seat 40, which in turn closes pressure control passage 42 and variable pressure passage 61 to fluid communication with low pressure passage 46. Pressure control passage 42 and variable pressure passage 61 are then fluidly connected to the source of high pressure actuation fluid 13 via control volume cavity 43 and high pressure supply passage 33. Pressure control passage 42 again delivers high pressure actuation fluid to both spool volume control cavity 50 via first branch passage 49 and to needle control chamber 48 via second branch passage 47. The closing of low pressure seat 40 also exposes variable pressure passage 61 and therefore hydraulic surface 63 of pin 60 to high pressure from high pressure supply 13. The high pressure acting on closing hydraulic surface 63 of pin 60 holds fluid evacuation valve 58 closed. The high pressure in needle control chamber 48 acts on closing hydraulic surface 106 of needle valve member 102 and causes needle valve member 102 to move down to close nozzle outlet 100, cutting off fuel spray. In addition, because high pressure is now acting on the spool's control hydraulic surface 53, spool valve member 51 begins to move toward its up position under the action of spring 56.

As spool valve member 51 moves toward its up position, high pressure annulus 66 ceases to provide fluid communication between actuation fluid passage 68 and high pressure supply passage 33, and low pressure annulus 69 again provides fluid communication between actuation fluid passage 68 and low pressure passage 25. In addition, as spool valve member 51 moves upward, it no longer contacts and holds closed pressure relief valve 71. This ensures that excess pressure in actuation fluid passage 68 can be vented through pressure relief valve 71 and out through pressure relief passage 96, thus preventing any secondary injection events. With the return of high pressure to spool control volume cavity 50, spool valve member 51 becomes hydraulically balanced once again and moves toward its upward position by the action of biasing spring 56.

Shortly before the opening of pressure control passage 42 to low pressure passage 46, the downward descent of piston 80 and plunger 81 stops. Once piston hydraulic surface 83 is open to low pressure in actuation fluid passage 68, piston 80 and plunger 81 move toward their upward biased positions under the action of biasing spring 103. This upward movement of plunger 81 relieves the pressure on fuel within fuel pressurization chamber 86 and causes a corresponding drop in pressure in fuel supply passage 107 and nozzle chamber 105. Between injection events, various components of injector body 31 begin to reset themselves in preparation for the next injection event. Because the pressure acting on piston 80 and plunger 81 has dropped, return spring 108 moves piston 80 and plunger 81 back to their retracted positions. The retracting movement of plunger 81 causes fuel from fuel inlet 88 to be drawn into fuel pressurization chamber 86 via fuel supply passage 107.

The present invention allows hydraulically actuated fuel injectors to perform better in a wider range of temperatures by reducing the need for a large amount of hydraulic fluid to flow around pilot valve member 39 and past low pressure seat 40. In earlier injectors of this type, the only drain path was the relatively small flow area around low pressure seat 40. This created difficulty in displacing hydraulic fluid from under the spool when downward travel of the spool was necessary at the start of an injection event. Because this path, out through branch passage 49, back up variable pressure passage 42, then around low pressure seat 40 is so small, viscous hydraulic oil (i.e., cold oil) could sometimes could not be drained fast enough to obtain accurate start of injection timing.

The present invention offers an effective solution to these problems. The fluid displaced by the downward movement of spool valve member 51 is allowed to drain through fluid evacuation valve 58. During cold starting conditions, this design affords the relatively viscous hydraulic fluid an alternate pathway by which to drain from spool control volume cavity 50, minimizing the problems resulting from the failure to quickly displace enough fluid past low pressure seat 40.

It should be understood that the present description is for illustrative purposes only and is not intended to limit the scope of the present invention in any way. Although the invention was described in the context of a hydraulically actuated fuel injector, a wide variety of pilot operated spool valve assemblies could benefit from the present invention. This is particularly true for valves that use relatively high viscosity fluids and/or require substantial fluid displacement past the pilot valve member in order to operate properly. Thus, those skilled in the art will appreciate that other aspects and features of the present invention can be obtained from a study of the drawings, the disclosure, and the appended claims.

I claim:

1. A pilot operated spool valve assembly comprising:

a valve body defining a high pressure passage, a low pressure passage, a pressure control passage and a low pressure space;

a spool valve member movably positioned in said valve body and having a control hydraulic surface exposed to fluid pressure in said pressure control passage;

a pilot valve member positioned in said valve body and having a first position in which said high pressure passage is fluidly connected to said pressure control passage, and a second position in which said low pressure passage is fluidly connected to said pressure control passage; and a fluid evacuation valve member positioned in said valve body and being moveable between an open position in which said pressure control passage is fluidly connected to said low pressure space and a closed position.

2. The pilot operated spool valve assembly of claim 1 wherein said fluid evacuation valve member has a closing hydraulic surface exposed to fluid pressure in said pressure control passage.

3. The pilot operated spool valve assembly of claim 1 including an electrical actuator attached to said valve body and being operably coupled to said pilot valve member.

4. The pilot operated spool valve assembly of claim 1 wherein said fluid evacuation valve member includes a pin and a ball.

5. The pilot operated spool valve assembly of claim 1 wherein said spool valve member includes a biasing hydraulic surface oriented in opposition to said control hydraulic surface and being exposed to fluid pressure in said high pressure passage.

6. The pilot operated valve assembly of claim 1 including a source of high pressure oil fluidly connected to said high pressure passage.

7. A hydraulic device comprising:

a device body defining a high pressure passage, a low pressure passage, a pressure control passage, an actuation fluid passage and a low pressure space;

a spool valve member positioned in said device body and having a control hydraulic surface exposed to fluid pressure in said pressure control passage, and being moveable between an on position in which said actuation fluid passage is open to said high pressure passage, and an off position in which said actuation fluid passage is open to said low pressure passage;

a pilot valve member positioned in said device body and having a first position in which said high pressure passage is fluidly connected to said pressure control passage, and a second position in which said low pressure passage is fluidly connected to said pressure control passage;

a fluid evacuation valve member positioned in said device body and being moveable between an open position in which said pressure control passage is fluidly connected to said low pressure space and a closed position; and a piston movably positioned in said device body and having a hydraulic surface exposed to fluid pressure in said actuation fluid passage.

8. The hydraulic device of claim 7 wherein said fluid evacuation valve member has a closing hydraulic surface exposed to fluid pressure in said pressure control passage.

9. The hydraulic device of claim 8 including an electrical actuator attached to said device body and being operably coupled to said pilot valve member.

10. The hydraulic device of claim 9 including a source of high pressure oil fluidly connected to said high pressure passage.

11. The hydraulic device of claim 10 wherein said spool valve member includes a biasing hydraulic surface oriented in opposition to said control hydraulic surface and being exposed to fluid pressure in said high pressure passage.

12. The hydraulic device of claim 11 wherein said fluid evacuation valve member includes a pin and a ball.

13. The hydraulic device of claim 12 wherein said hydraulic device is a hydraulically actuated fuel injector.

14. The hydraulic device of claim 13 wherein said hydraulically actuated fuel injector includes an injector body; and a direct control needle valve member is movably positioned in said injector body and includes a closing hydraulic surface exposed to fluid pressure in a needle control chamber defined by said injector body.

15. A method of operating a control valve comprising:

providing a pilot operated spool valve assembly including a valve body that defines a high pressure passage and a low pressure passage, and includes a spool valve member, a pilot valve member and a fluid evacuation valve member;

moving said pilot valve member to a first position to expose a control hydraulic surface of said spool valve member and a closing hydraulic surface of said fluid evacuation valve member to said low pressure passage;

moving said spool valve member toward an on position to expose said fluid evacuation valve member to fluid pressure;

moving said fluid evacuation valve member to an open position;

moving said pilot valve member to a second position to expose a control hydraulic surface of said spool valve member and a closing hydraulic surface of said fluid evacuation valve member to said high pressure passage;

moving said spool valve member toward an off position; and moving said fluid evacuation valve member to a closed position.

16. The method of claim 15 wherein said fluid evacuation valve member includes a ball; and said step of moving said fluid evacuation valve member to an open position includes exposing said ball to fluid pressure by moving said spool valve member toward said on position.

17. The method of claim 16 wherein said valve body defines a pressure control passage and a fluid evacuation passage; and displacing an amount of actuation fluid from said pressure control passage through said fluid evacuation passage and past said fluid evacuation valve member at least in part by moving said spool valve member from said off position to said on position.

18. The method of claim 17 wherein an electronic actuator is operably coupled to said pilot valve member; and said step of moving said pilot valve member to said first position includes energizing said electronic actuator.

19. The method of claim 18 including a step of exposing a biasing hydraulic surface of said spool valve member to fluid pressure in said high pressure passage.

20. The method of claim 19 including a step of mechanically biasing said spool valve member toward said off position.

* * * * *